US006568404B2

(12) United States Patent
Mitchem

(10) Patent No.: US 6,568,404 B2
(45) Date of Patent: May 27, 2003

(54) HAIR TREATMENT APPLICATOR

(76) Inventor: Paul Blythe Mitchem, 717 W. Pine St., Johnson City, TN (US) 37604

( * ) Notice: Subject to any disclaimer, the term of this patent is extended or adjusted under 35 U.S.C. 154(b) by 6 days.

(21) Appl. No.: 09/876,665

(22) Filed: Jun. 7, 2001

(65) Prior Publication Data

US 2002/0185145 A1 Dec. 12, 2002

(51) Int. Cl.[7] ..... A45D 19/00

(52) U.S. Cl. ..... 132/112; 132/270; 401/265

(58) Field of Search ..... 132/108, 109, 132/110, 111, 112, 113, 114, 115, 116, 148, 207, 208, 221, 313, 314, 317, 320, 270; 401/11, 183, 198, 199, 261, 262, 263, 265, 266, 283; D28/7, 10

(56) References Cited

U.S. PATENT DOCUMENTS

| | | | | | |
|---|---|---|---|---|---|
| 1,964,512 | A | * | 6/1934 | Halpern | 401/185 |
| 2,453,201 | A | | 11/1948 | Cushman | |
| 2,596,296 | A | * | 5/1952 | Shields | 132/160 |
| 2,811,732 | A | * | 11/1957 | Okamoto | 184/102 |
| 2,819,723 | A | * | 1/1958 | Meyer | 132/116 |
| 4,211,247 | A | * | 7/1980 | Morganroth | 132/270 |
| 4,385,638 | A | * | 5/1983 | Hasegawa | 132/270 |
| 4,462,413 | A | * | 7/1984 | Schmitz | 132/113 |
| 4,727,893 | A | * | 3/1988 | Goncalves | 132/320 |
| 4,993,437 | A | | 2/1991 | Kimura | |
| 5,059,050 | A | * | 10/1991 | Guglielmo | 401/171 |
| 5,060,679 | A | * | 10/1991 | Christopher et al. | 132/114 |
| 5,067,501 | A | * | 11/1991 | Auger | 132/116 |
| 5,307,825 | A | | 5/1994 | Smith | |
| 5,676,480 | A | | 10/1997 | Tosto | |
| 5,778,902 | A | | 7/1998 | Nagy | |
| 5,937,866 | A | | 8/1999 | Magharehi | |
| 5,954,443 | A | * | 9/1999 | Bacon | 401/192 |
| 5,960,802 | A | | 10/1999 | Sakai | |
| 5,964,226 | A | | 10/1999 | Sobel | |
| 6,112,751 | A | * | 9/2000 | Bennett | 132/116 |
| 6,145,513 | A | | 11/2000 | Chu | |

* cited by examiner

*Primary Examiner*—Kevin Shaver
*Assistant Examiner*—David Comstock
(74) *Attorney, Agent, or Firm*—Susan F. Johnston

(57) ABSTRACT

An applicator for depositing a hair treatment fluid composition to a discreet strand of hair. The applicator is a longitudinal container having a hook-shaped coating tip. The applicator has an inner surface defining a reservoir therein for containing the hair treatment fluid composition. The hook-shaped coating tip defines a transverse channel adapted to receive a cross-section of a strand of hair. At least one orifice extends from the reservoir to the transverse channel to allow the hair treatment fluid composition to flow from the reservoir into the transverse channel. Using the present apparatus, the hair treatment fluid composition may be deposited on the discreet strand of hair held in the channel without inadvertently coating the adjacent mane.

15 Claims, 3 Drawing Sheets

Fig. 1
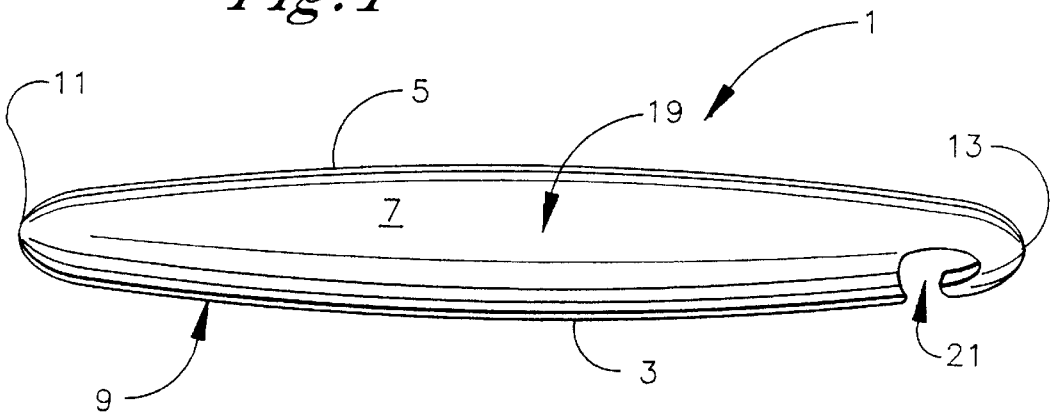
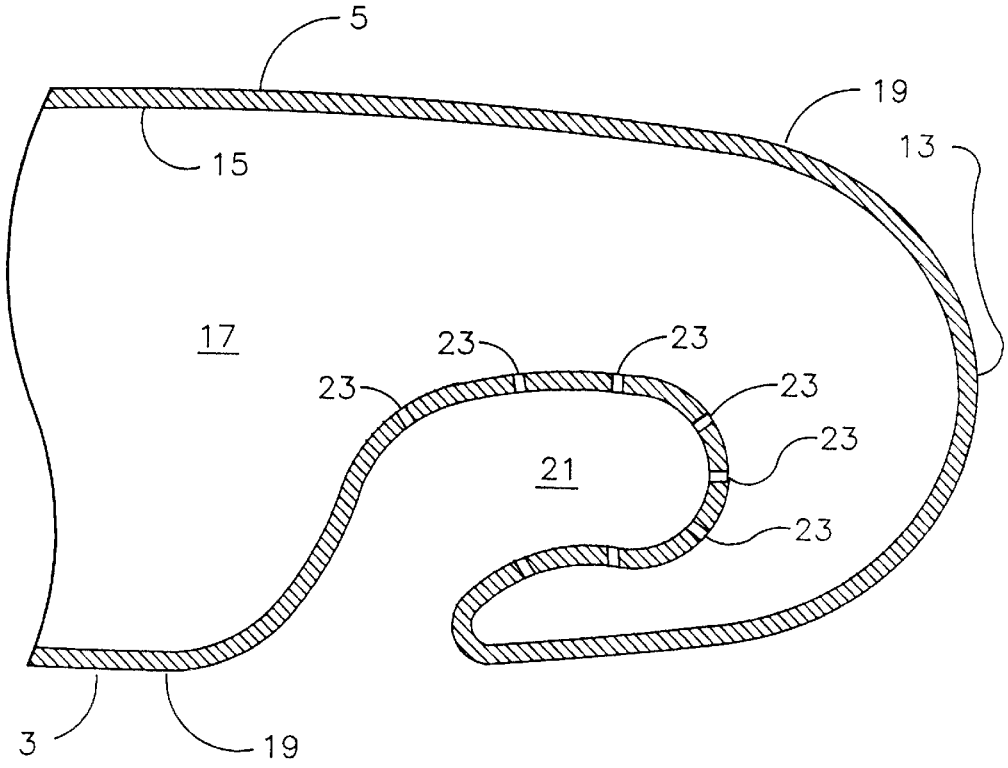
Fig. 2

HAIR TREATMENT APPLICATOR

CROSS REFERENCES TO RELATED APPLICATIONS

This application claims no priority rights to any other US or foreign document.

BACKGROUND OF THE INVENTION

1. Field of the Invention.

The present invention relates to an apparatus for applying a hair treatment fluid composition such as a dye. The present invention more particularly pertains to applying a hair treatment composition to discreet strands of hair.

2. Description of the Prior Art.

The use of applicators for applying dye and other hair treatment fluid compositions to discreet strands of hair is known in the art. This type of applicator is distinguished from applicators used to deposit a composition on the entire mane, and is hereinafter referred to as a "strand applicator" for convenience. Strand applicators are useful for depositing a composition to change the color of discreet strands of hair, in contrast with the primary color of the mane, thus providing a streaked or highlighted appearance. Strand applicators are also useful for depositing dye onto discreet strands of gray hair to reduce the contrast between the gray hair and the adjacent mane. Strand applicators may also be used to apply a bleach, a hair nutrient or other fluid composition to discreet strands.

The construction of strand applicators used in the art generally falls into two categories, the pen-style applicator and the comb-style applicator. The pen-style strand applicators include a reservoir containing a wick made from an absorbent material such as hard felt. The wick is positioned inside the reservoir and extends outside the reservoir at the coating end of the applicator, thus drawing fluid from inside the reservoir to enable controlled contact with the strand of hair. Examples of pen-style applicators are disclosed in U.S. Pat. No. 5,960,802; U.S. Pat. No. 5,964,226; and U.S. Pat. No. 5,778,902.

Comb-style strand applicators include a plurality of parallel members extending from the coating end of a reservoir to provide even coating of the strand of hair with the fluid contained in reservoir. Examples of comb-style strand applicators are disclosed in U.S. Pat. No. 4,993,437; U.S. Pat. No. 5,937,866; and U.S. Pat. No. 5,676,480.

The aforementioned patents disclose strand applicators that require the user to separate the discreet strand of hair from the surrounding mane during treatment in order to restrict deposition of dye or other composition to the discreet strand of hair. Users typically isolate the strand of hair from the mane by lifting the strand of hair away from the mane or by placing a non-absorbent sheet between the strand of hair and the adjacent mane. It should be appreciated that such measures for isolating a strand of hair during treatment prove especially cumbersome when treating very short hair.

In light of the above, it would be desirable to provide a strand applicator constructed to shield the adjacent mane from deposition of the hair treatment composition while the composition is being deposited onto a discreet strand of hair. It would be further desirable for such a strand applicator to provide even deposition of a hair treatment composition to the strand of hair.

BRIEF SUMMARY OF THE INVENTION

The device of the present invention is a hair treatment fluid applicator for depositing a hair treatment fluid composition to a discreet strand of hair while shielding the adjacent mane against deposition.

The present applicator comprises a container having a front side, a back side, an upper side, and a lower side with the sides positioned longitudinally between an enclosed proximal end and an enclosed distal end, an inner surface defining a reservoir for containing the hair treatment fluid composition, and an outer surface. A section of the outer surface disposed transversely across the front side near the distal end is indented laterally toward the distal end to form a "hook-shaped" coating tip defining a transverse channel disposed between the front side and the back side and connecting the upper side with the lower side. The transverse channel is adapted to receive a cross-section of a strand of hair. The container has at least one orifice extending from the reservoir to the transverse channel to allow the hair treatment fluid to flow from the reservoir into the transverse channel. In an alternative embodiment of the present applicator, instead of the outer surface being indented, the distal end of the container is bent backwards toward the proximal end to form the hook-shaped coating tip and transverse channel.

BRIEF DESCRIPTION OF THE DRAWINGS

FIG. 1 is side elevation view of the applicator of the present invention.

FIG. 2 is a cross sectional view of the distal end of an indented embodiment of the present applicator adapted to be used without a wick.

DETAILED DESCRIPTION

Figure 3:
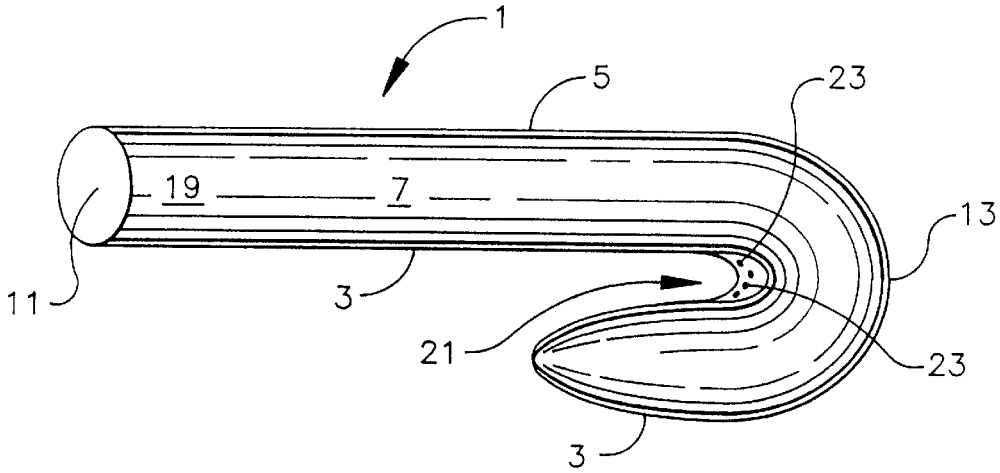
FIG. 3 is a proximal end-side view of an embodiment of the present applicator having a bent distal end and being adapted for use without a wick.

The Applicant has invented a strand applicator having a hook-shaped coating tip. The hook-shaped tip provides a channel suitable to receive and hold a cross section of a strand of hair. At least one orifice extends from the interior of the applicator to the channel so that the hair treatment fluid composition stored inside the strand applicator may flow onto the cross section of hair held in the channel. This construction is particularly beneficial for circumventing strand isolation difficulties often encountered with very short hair due to the fact that the hook-shaped coating tip serves both to hold the strand of hair in contact with the dye flowing through the orifice and to shield the cross section of hair being coated from the adjacent mane. The invention is more particularly described by reference to preferred embodiments of the strand applicator shown in the drawings and described below.

FIGS. 1 and 2 illustrate an embodiment of the present applicator that includes a container 1 having a front side 3, a back side 5, an upper side 7, and a lower side 9, with the sides being positioned longitudinally between an enclosed proximal end 11 and an enclosed distal end (coating end) 13. The applicator further has an inner surface 15 defining a reservoir 17 for the hair treatment fluid composition and an outer surface 19. A section of the outer surface 19 disposed transversely across the front side 3 near the distal end 13 is indented laterally toward the distal end 13 of the container. The indented portion of the outer surface thus defines a transverse channel 21 disposed between the front side 3 and the back side 5 which connects the upper side 7 with the lower side 9. The transverse channel 21 has a shape suitable to receive a cross-section of a strand of hair, preferably a cross section of hair having a diameter no greater than about one inch, with a diameter no greater than about one-half inch being more preferable. The container 1 has at least one orifice 23 extending from the reservoir 17 to the transverse channel 21 to allow the hair treatment fluid composition to flow from the reservoir 17 into the transverse channel 21.

FIG. 3 illustrates an alternative embodiment of the present strand applicator wherein the distal end 13 of the applicator is actually bent in a hook-like manner instead of being indented as shown in FIG. 1 to form the transverse channel 21. The bent embodiment of the present applicator naturally provides less shielding between the strand being treated and the adjacent mane and provides less deposition around the perimeter of the cross section of hair, as compared to the indented embodiment shown in FIG. 1.

Figure 4:
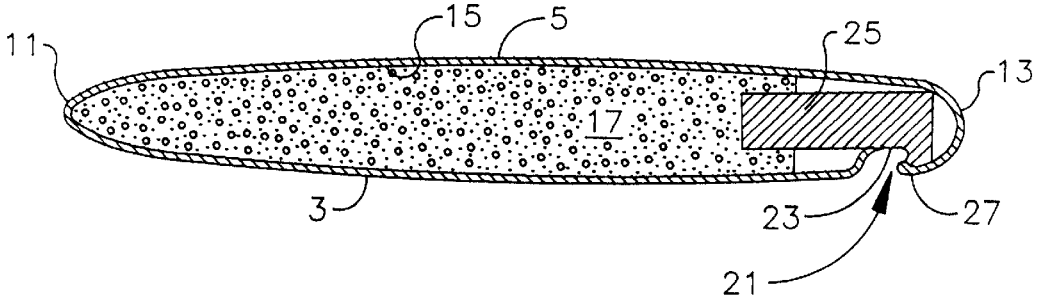
FIG. 4 is a cross sectional view of an indented embodiment of the present applicator having a single large orifice and containing a concave wick.
Figure 5:
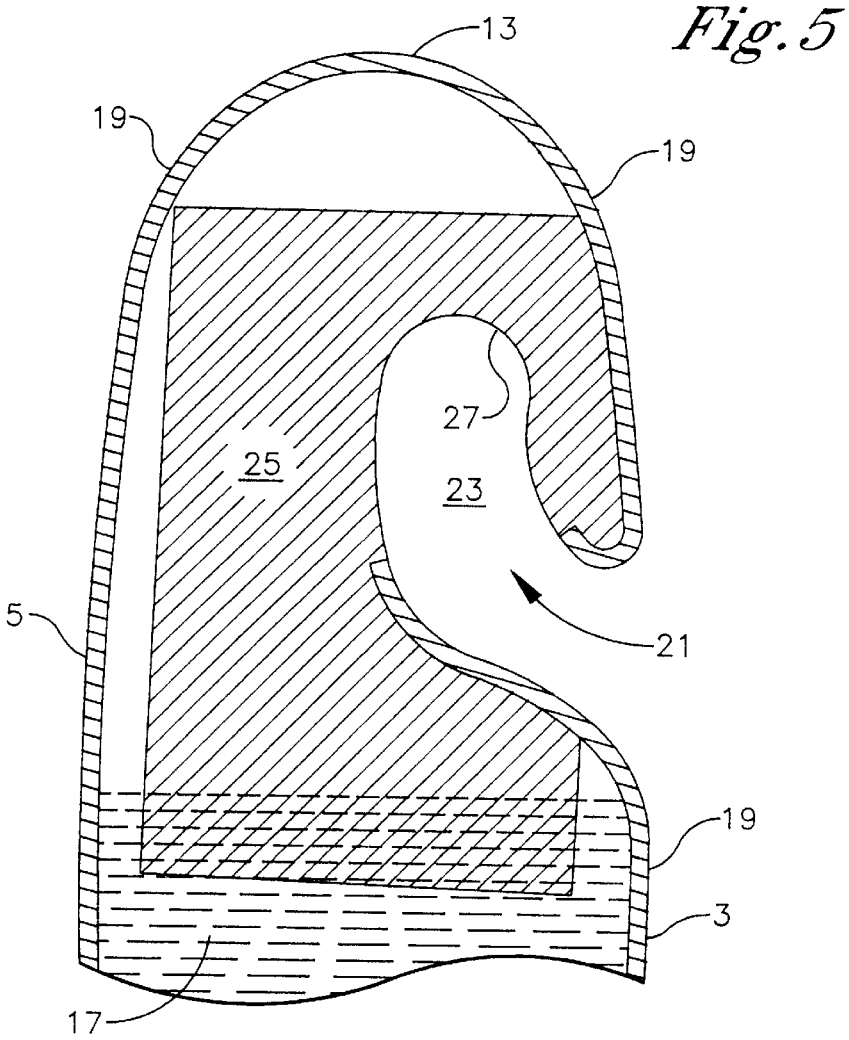
FIG. 5 is a cross sectional view of the distal end of an indented embodiment of the present applicator containing a concave wick.

In an additional embodiment of the present invention, the applicator may additionally include a wick 25 adapted to control the flow of the hair treatment fluid composition into the transverse channel, as shown in FIGS. 4 and 5. Such wicks are known in the art and include hard felt and other inert materials having an extractive or liquid permeative property. The wick 25 is disposed in reservoir and extends from the reservoir to the transverse channel 21 to provide a wick contact surface 27 useful for contacting the hair strand during treatment. While multiple orifices may be incorporated into the embodiment that includes a wick, a single large orifice providing access to the wick contact surface is preferable. In such embodiment including a wick accessed through a single large orifice, the wick contact surface is preferably concaved in order to increase the surface area contacting the hair. The concaved wick contact surface is more preferably concaved toward the distal end of the applicator, as shown in FIGS. 4 and 5.

The present applicator may be filled with any useful hair treatment fluid composition. Examples of useful compositions include dyes, bleaches, nutrients, cosmetic enhancers, texture modifiers, and such. As used herein, a fluid composition includes any composition that can flow from the reservoir through the orifice and into the transverse channel. Such fluid compositions include liquids, aqueous and non-aqueous solutions, gels, pastes, suspensions, melts, and such. A wickless embodiment of the present applicator can be used to apply both high viscosity and low viscosity fluid compositions. However, an applicator containing a wick is typically used to apply low viscosity liquids and solutions.

The applicator of the present invention may be formed from known container materials that are hard, soft, or a combination thereof. It is anticipated that a soft-sided, squeezable, wickless applicator formed from a soft plastic or metal would be particularly beneficial when filled with a high viscosity hair treatment fluid composition such as a gel or a paste.

Figure 6:
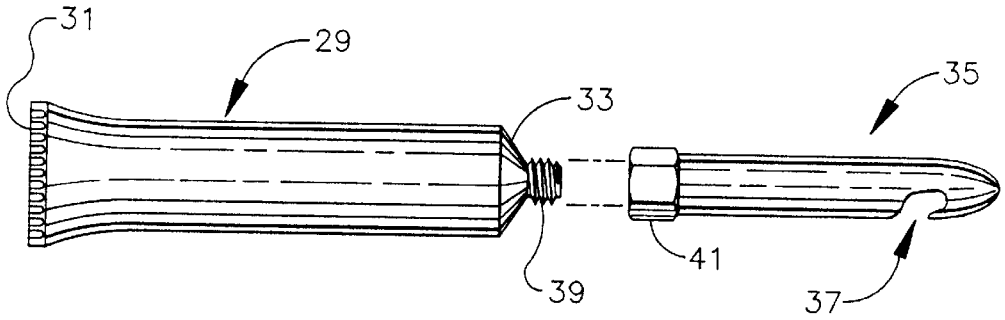
FIG. 6 is an exploded side view of a two-component embodiment of the present applicator.

FIG. 6 illustrates an example of a multi-component applicator of the present invention combining a hard coating tip with a soft squeezable body of the type traditionally used to package tooth paste. The first component of the two-component applicator shown in FIG. 6 is an elongated tubular member 29 having an enclosed proximal end 31, an open distal end 33, and an inner surface forming a main reservoir. The second component is a hollow, hook-shaped coating tip 35 connectable to the distal end 33 of the elongated member 29. The hook-shaped coating tip 35 has an inner surface defining a tip reservoir therein. The hook-shaped coating tip 35 defines a channel 37 adapted to receive a cross-section of a strand of hair, just like the aforementioned integrally formed applicators. FIG. 6 illustrates that the two components are matingly threadable with each other via threaded connectors 39, 41. However, any connection means that provides communication between the main reservoir and the tip reservoir is suitable. The present invention also includes a multi-component applicator that is totally hard or totally soft.

The invention has been described in detail with particular reference to preferred embodiments thereof, but it will be understood that variations and modifications can be effected within the spirit and scope of the invention.

What is claimed is:

1. A device for applying a hair treatment fluid composition to a strand of hair comprising:

a container having a front side, a back side, an upper side, and a lower side with said sides positioned longitudinally between an enclosed proximal end and an enclosed distal end, an inner surface defining a reservoir for containing the hair treatment fluid composition, an outer surface, and a hook-shaped tip near said distal end defining a transverse channel extending transversely from said upper side to said lower side, said transverse channel extending laterally from said front side then distally between said front side and said back side to a channel end adjacent said distal end, said transverse channel being adapted to receive a cross-section of a strand of hair through said channel to said channel end, said container having at least one orifice extending from said reservoir to said channel end.

2. The device according to claim 1 wherein said container has a plurality of orifices extending from said reservoir to said transverse channel at positions about said transverse channel.

3. The device according to claim 2 wherein said positions about said transverse channel are located essentially oppositely across said channel.

4. The device according to claim 2 wherein said container is a soft-sided container formed from a soft material.

5. The device according to claim 4 wherein said reservoir is filled with a hair treatment fluid composition having a high viscosity.

6. The device according to claim 1 further comprising a wick disposed in said reservoir and extending from said reservoir through said at least one orifice to said channel end to provide a wick contact surface.

7. The device according to claim 6 wherein said wick contact surface is concave toward said outer surface.

8. The device according to claim 6 wherein said reservoir is filled with a hair treatment fluid composition having a low viscosity.

9. The device according to claim 1 wherein said proximal end is a soft tube and said distal end is hard.

10. The device according to claim 9 wherein said proximal end and said distal end are separate pieces in connectable communication with each other.

11. A device for applying a hair treatment fluid composition to a strand of hair comprising:

an elongated container having an inner surface defining a reservoir for containing the hair treatment fluid composition, said container comprising a longitudinal cylinder having an enclosed proximal end and an enclosed distal end, with said distal end being bent backwards toward said proximal end to define a transverse channel adapted to receive a cross-section of a strand of hair, said container having at least one orifice extending from said reservoir to said transverse channel adapted to allow the hair treatment fluid to flow from said reservoir into said transverse channel.

12. The device according to claim 11 wherein said container has a plurality of essentially oppositely positioned orifices extending from said reservoir to said transverse channel.

13. The device according to claim 11 further comprising a wick disposed in said reservoir and extending from said reservoir to said transverse channel.

14. The device according to claim 11 wherein said proximal end and said distal end are separate members matingly connected to each other.

15. The device according to claim 14 wherein said proximal end is a soft tube and said distal end is hard.

* * * * *